US007998311B2

(12) United States Patent
Varnell

(10) Patent No.: US 7,998,311 B2
(45) Date of Patent: Aug. 16, 2011

(54) ENHANCED SURFACE SIZING OF PAPER

(75) Inventor: Daniel F. Varnell, Wilmington, DE (US)

(73) Assignee: Hercules Incorporated, Wilmington, DE (US)

( * ) Notice: Subject to any disclaimer, the term of this patent is extended or adjusted under 35 U.S.C. 154(b) by 311 days.

(21) Appl. No.: 12/178,904

(22) Filed: Jul. 24, 2008

(65) Prior Publication Data

US 2010/0018660 A1 Jan. 28, 2010

(51) Int. Cl.
*D21H 17/65* (2006.01)
*D21H 23/22* (2006.01)

(52) U.S. Cl. ..... 162/135; 162/158; 162/164.6; 162/168.1; 162/168.2; 162/175; 106/287.2; 106/287.23; 106/287.24; 427/391; 427/395; 524/77; 524/81; 524/112; 524/500; 524/800

(58) Field of Classification Search ..... 106/164.3, 106/164.4, 209.1, 214.1, 215.1–215.4, 217.6, 106/217.7, 287.2, 287.23, 287.24, 287.25; 162/135, 158, 164.1, 164.6, 168.1, 168.2, 162/169, 175, 184; 427/384, 394, 395; 524/77, 524/81, 112, 356, 500, 773, 774, 800, 802, 524/815, 816, 827, 831, 832, 846
See application file for complete search history.

(56) References Cited

U.S. PATENT DOCUMENTS

| | | | | |
|---|---|---|---|---|
| 3,499,824 | A * | 3/1970 | Kulick et al. | 162/164.3 |
| 4,278,794 | A | 7/1981 | Wegleitner et al. | |
| 4,317,756 | A | 3/1982 | Dumas | |
| 4,478,682 | A | 10/1984 | Bankert et al. | |
| 4,784,727 | A * | 11/1988 | Schroer et al. | 162/158 |
| 5,169,886 | A | 12/1992 | Bung et al. | |
| 5,456,800 | A * | 10/1995 | Tansley et al. | 162/158 |
| 5,470,742 | A | 11/1995 | Bull et al. | |
| 6,162,328 | A | 12/2000 | Cenisio et al. | |
| 6,207,258 | B1 | 3/2001 | Varnell | |
| 6,554,961 | B1 | 4/2003 | Riehle et al. | |
| 7,270,727 | B2 | 9/2007 | Varnell | 162/164.6 |
| 2003/0127204 | A1 | 7/2003 | Varnell | 162/135 |
| 2004/0016528 | A1 | 1/2004 | Varnell | 162/164.6 |
| 2008/0163993 | A1 | 7/2008 | Varnell | 162/135 |

FOREIGN PATENT DOCUMENTS

| | | |
|---|---|---|
| EP | 0 580 405 | 7/1993 |
| WO | 99/16973 | 4/1999 |
| WO | 03/022898 | 3/2003 |
| WO | 2008/086029 | 7/2008 |

OTHER PUBLICATIONS

Scott, William E., *Principles of Wet End Chemistry*, Chapter 14, pp. 99-109, 1996, Tappi Press, Atlanta, ISBN 089852-286-2.

Biermann, Christopher J., *The Handbook of Pulping and Papermaking*, pp. 171-174, 1996, Academic Press, San Diego, ISBN 0-12-097362-6.

Scott, William E. and Abbott, James C., *Properties of Paper: An Introduction Ed.*, pp. 123-131, 1995, Tappi Press, Atlanta, ISBN 0-89852-062-2.

*Cobb Test*, Gurley Precision Instruments, 3 pages, www.gpi-test.com/cobb.htm.

* cited by examiner

*Primary Examiner* — Eric Hug
*Assistant Examiner* — Peter Chin
(74) *Attorney, Agent, or Firm* — Patricia Smink Rogowski; Joanne Mary Fobare Rossi

(57) ABSTRACT

Size press compositions and methods for producing sized paper products, including liner board, are disclosed. The size press compositions contain at least one non-reactive cationic surface sizing agent, at least one reactive sizing agent, at least one promoter resin, at least one binder, and water. The at least one non-reactive cationic surface sizing agent may be a polymer in the form of a dispersion, an emulsion or a latex with a positive zeta potential below about pH 6. The at least one reactive sizing agent may be a dispersion, an emulsion or a latex including an alkyl ketene dimer or an alkyl succinic anhydride. The at least one promoter resin may be a polyaminoamide-epichlorohydrin resin or poly (dimethyldiallylammonium chloride).

15 Claims, No Drawings

ENHANCED SURFACE SIZING OF PAPER

TECHNICAL FIELD

The disclosure relates to surface sizing of paper products, including fine paper and liner board. Size press compositions, paper compositions to which the size press compositions are applied, and methods for producing sized paper products are disclosed.

BACKGROUND OF THE DISCLOSURE

Paper sizing refers to the ability of a paper to hold out a liquid or for preventing such liquid from penetrating into or through the paper. Generally the liquid that is held out is water. Compounds that are designed to increase the hold-out of liquids are known as sizing agents. Sometimes a specific type of sizing is referred to, such as an oil sizing agent. For a discussion on sizing see *Principles of Wet End Chemistry*, by William E. Scott, Tappi Press (1996), Atlanta, ISBN 0-89852-286-2. Sizing values are specific to the test used.

In papermaking and paper finishing, a sizing agent often is employed to provide desirable characteristics sought in the ultimate paper product. Sizing, or sizing property, is a measure of the resistance of a manufactured paper or paperboard product to the penetration or wetting by an aqueous liquid, which may be water. Sizing agents are internal additives employed during papermaking or external additives employed as surface treatment agents during paper finishing that increase this resistance.

Papermaking can be carried out under acidic, neutral, or alkaline pH conditions, and the selection of a sizing agent usually depends upon the pH used. For example, rosin-derived sizing agents typically are used under acidic papermaking conditions. Under alkaline pH conditions, which are widely used in fine paper manufacturing applications, typical sizing agents include alkyl ketene or alkenyl dimers or acid anhydrides, such as alkenyl succinic anhydrides.

A sizing agent may be added to liner board or recycle liner board at the size press on the paper machine. The sizing is often obtained by adding a cationic polymer latex, such as a latex of a polymer of styrene and acrylic monomers. The size press typically contains a dissolved starch, the sizing agent, and other additives. The pH of the size press when the cationic latexes are used is usually between 4.5 and 5.5. At higher pH, the cationic sizing agents are much less efficient at developing sizing. Reactive sizing agents also may be used to size paper, and they are more efficient when the size press pH is above 6.0. Reactive sizing agents are not used extensively for sizing liner board materials, however, because they reduce the coefficient of friction and slide angle of the paper.

Current technology for surface sizing liner board or recycle line board paper relies on application of cationic latex or rosin sizing agents. The efficiency of the sizing is mediocre, and there is room for significant improvement. The sizing is generally conducted at a pH significantly below pH 7, typically at about pH 5.5. Reactive sizing agents are known to provide more efficient sizing when used at the size press in sizing "fine paper," that is paper for printing and writing applications. However, the use of reactive sizing agents in liner board applications is limited by the deleterious effect such sizing agents have on the coefficient of friction of the final board as noted above.

Accordingly improved methods of sized paper products are desirable in paper making size technology.

SUMMARY OF THE DISCLOSURE

The disclosure relates to size press compositions for use in sizing paper or liner board. The compositions contain at least one non-reactive cationic surface sizing agent, at least one reactive sizing agent, at least one promoter resin, at least one binder, and water. The disclosure also relates to a paper or liner board that is sized with the size press composition, and a method for producing sized paper or sized liner board with the size press composition.

DETAILED DESCRIPTION OF THE DISCLOSURE

One embodiment of the disclosure includes a sizing composition containing;

(a) at least one non-reactive surface sizing agent,
(b) at least one reactive sizing agent,
(c) at least one promoter resin, and
(d) water.

Components (a), (b), and (c) are the active components and component (a) is present in the composition from about 30 to about 95% by weight based on the total active components ((a), (b) and (c)) and more typically from about 60 to about 80% by weight based on the total active components ((a), (b) and (c)). Component (b) is present in the composition from about 5 to about 70% by weight based on the total active components and more typically from about 20 to about 40% by weight based on the total active components ((a), (b) and (c)), and component (c) is present in the composition from about 2 to about 20% by weight based on the total active components and more typically from about 5 to about 15% by weight based on the total active components ((a), (b) and (c)). The composition is utilized in a sizing agent formulation for use in sizing paper.

Another embodiment of the disclosure involves a size press composition that contains the sizing composition described above, and further includes at least one binder (component (e)). The at least one binder (e) is present in the size press composition from about 2 to about 12% by weight based on the total weight of the size press composition and more typically from about 6 to about 10% by weight based on the total weight of the size press composition. The size press composition contains from about 0.15 to about 1% by weight of the at least one non-reactive cationic surface sizing agent (a) based on the total weight of the size press composition. The size press composition contains from about 0.025 to about 0.8% by weight of the at least one reactive sizing agent (b) based on the total weight of the size press composition, and contains from about 0.01 to about 0.2% by weight of the at least one promoter resin (c) based on the total weight of the size press composition. More typically, the size press composition contains from about 0.3 to about 0.85% by weight of the at least one non-reactive cationic surface sizing agent (a) based on the total weight of the size press composition, from about 0.1 to about 0.45% by weight of the at least one reactive sizing agent (b) based on the total weight of the size press composition, and from about 0.025 to about 0.16% by weight of the at least one promoter resin (c) based on the total weight of the size press composition.

Other embodiments of the disclosure include a paper composition containing paper that has been sized with the size press composition described above. The paper composition has a sizing value greater than 20 seconds as measured by the Hercules Sizing Test (HST). Sizing values are specific to the test used, and the HST (Tappi Method T530) is described in more detail in the Examples below. The paper composition is produced by applying the size press composition described above to paper with a size press.

When a reactive sizing agent is combined with a non-reactive sizing agent for use in liner board, the two should be balanced so that adequate sizing is achieved without losing a large amount of friction. As noted above, a reactive sizing agent can provide good sizing for liner board, but has drawbacks because friction decreases. However, a reactive sizing agent is much less effective as the size press formulation pH goes below 7, which is required for good performance from cationic non-reactive sizing agents. Typically, reactive sizing agents perform best at pH values above 7. Unexpectedly, we have found that when using a combination of reactive and non-reactive sizing agents, results can be improved by including at least one promoter resin so that a size press formulation at a pH below about pH 6 may be used. The at least one promoter resin allows the non-reactive size agent(s) to work at optimal pH range below 6, while further allowing the reactive size agent(s) to perform well at this lower pH range. The result is unexpected because reactive size agents are known in the background art to perform poorly at pH ranges below pH 6. In addition, we found that the at least one promoter resin unexpectedly improved the performance of the at least one non-reactive sizing agent, even when no reactive sizing agent was present, which demonstrates that the promoter resin improves efficacy of both the reactive and non-reactive sizing agents.

Typically, the at least one non-reactive cationic surface sizing agent (component (a)) is a polymer in the form of a dispersion, an emulsion or a latex. The zeta potential of the polymer is positive below about pH 6, and the polymer has a primary glass transition temperature between about 10 and about 80° C. Non-limiting polymer examples include polymers based on styrene and acrylates, or combinations of these. One such polymer is a random copolymer of 57% by weight styrene and 38% by weight n-butyl acrylate formed by a free radical emulsion polymerization method with a cationic nature obtained by incorporating into the polymer a third monomer that is cationic, such as dimethylaminopropylacrylamide. The polymer might also be a combination of acrylic monomers, such as those described in U.S. Pat. No. 5,169,886. The non-reactive cationic surface sizing agents typically provide sizing to the paper when added at a level of at least 0.05% on a dry basis in the paper, and more typically at a level of at least 0.1% on a dry basis in the paper. Examples of non-reactive cationic surface sizing agents include Giulini Pergluten K532®, BASF Basoplast PR8262®, EKA SP CE28®, and Hercules Incorporated imPress® ST 830.

The at least one reactive sizing agent (component (b)) is typically an alkyl ketene dimer or an alkyl succinic anhydride, and is typically in the form of an aqueous dispersion, emulsion or latex. The alkyl ketene dimers have the formula of a dialkyl substituted propiolactone ring:

$$R_1—CH{=}(COC({=}O)CH)_{ring}—R_2$$

where $R_1$ and $R_2$ are saturated or unsaturated $C_6$ to $C_{24}$ hydrocarbon or a cycloalkyl having at least 6 carbon atoms, or an aryl, aralkyl or alkaryl hydrocarbon. This includes decyl, dodecyl, teradecyl, hexadecyl, octadecyl, aicosyl, docosyl, tetrocosyl, cyclohexyl, phenyl, benzyl and naphthyl ketene dimers. Also included are alkyl ketene dimers produced from palmitoleic acid, oleic acid, ricinoleic acid, lincleic acid, myristoleic acid and elecsteric acid. Other examples can be found in U.S. Pat. Nos. 6,207,258 and 6,162,328 the contents of which patents are incorporated by reference.

The at least one promoter resin (component (c)) can be any chemical that enhances the reactive and non-reactive sizing agents. Typically the promoter resins are cationic polymers and copolymers made from dimethyldiallylammonium chloride (DADMAC), methylalkylallyl ammonium chloride or diallylammonium chloride (DAAC) monomers. Other useful promoters include polymers, such as polyaminoamide resins, including polyaminoamide-epichlorohydrin resins, and poly (dimethyldiallylammonium chloride). Commercial examples include the Kymene® product line from Hercules Incorporated. Other examples may be found in U.S. Pat. Nos. 7,270,727; 4,478,682; 4,278,794; 4,317,756; 5,470,742 and 6,554,961, the contents of which patents are incorporated by reference. The disclosed sizing composition contains components (a), (b) and (c) and water (d), with components (a), (b) and (c) being the active components. Component (a) is present from about 30 to about 95% by weight based on the total active components, component (b) is present from about 5 to about 70% by weight based on the total active components and component (c) is present from about 2 to about 20% by weight based on the total active components. This composition is used as a sizing agent formulation for use in sizing paper or liner board. The solids of the sizing composition can range from about 5% to about 45%.

A size press composition that may be applied to paper or liner board in a size press contains components (a) to (d) as in the above sizing composition and at least one binder (component (e)). The at least one binder is present from about 2 to about 12% based on the total weight of the size press composition and the at least one non-reactive cationic surface sizing agent (component (a)) is present from about 0.15 to about 1% based on the total weight of the size press composition. Components (b) and (c) are present in the size press composition in the same ratio to component (a) as described above. Typically, component (a) is present from about 0.15 to about 1% by weight based on the total weight of the size press composition, component (b) is present from about 0.025 to about 0.8% by weight based on the total weight of the size press composition and component (c) is present from about 0.01 to about 0.2% by weight based on the total weight of the size press composition. The solids content can range from about 2% to 12%.

Typically, the size press composition is applied to paper or liner board from about 40 to about 120 pounds per ton of paper based on the total dry weight of components (a), (b), (c) and (e), and more typically from about 60 to about 100 pounds per ton of paper based on the total dry weight of components (a), (b), (c) and (e).

The at least one binder (component (e)) is typically a starch or a polyvinylalcohol or combinations of these two. The starch may be cationic, oxidized, ethylated, amphoteric, hydrophobically modified, as well as any other type of modified starch. The starches may be derived from corn, wheat, potatoes, cassava roots, rice and other starch sources. The starch source is not limited as long as it is suitable for treating paper or liner board and can be dissolved in water and applied to paper or liner board. Typically, the starches have reduced viscosities so that solutions of greater than about 6% solids can be used in a size press. The size press composition may also contain other components, including salts, fillers, antifoams, biocides, colorants, dyes, waxes, optical brightening agents and combinations of these components.

The size press composition is applied to the paper in a size press apparatus either on the paper machine (on-machine) or in a separate size press apparatus (off-machine). The sized paper typically has a sizing value greater than 20 seconds, and even more typically greater than 100 seconds, as measured by the Hercules Sizing Test (HST). Higher HST values represent more sizing. Typically, the size press composition has a pH below about 6, and a temperature between about 0 and about 70° C., more typically between about 45 and about 70° C.

A paper substrate that is sized with a sizing composition according to the disclosure can contain wood based pulp from groundwood to chemically bleached wood or a non-wood based pulp or a combination of pulps. In addition, the pulp may be obtained in whole or in part from recycled paper and paper products. The pulp may contain some synthetic pulp. The pulp may be some combination of pulp types, such as hardwood and soft wood or a certain type of wood, such as Eucalyptus. The pulp may be groundwood pulp, mechanical pulp, chemically or thermally treated pulp, kraft pulp, sulfite pulp or synthetic pulp or any other common pulp used in the paper industry. The paper may or may not contain inorganic fillers, such as calcium carbonate or clay, and may or may not contain organic fillers, sizing agents and other additives added at the wet-end of the paper machine. The paper also can contain strength additives, retention additives, internal sizing agents and other common paper additives, such as alum.

With respect to the sized paper, the at least one non-reactive cationic surface sizing agent (component (a)) is present in the paper on a dry weight basis in an amount greater than about 0.05% by weight based on the weight of the paper, the at least one reactive sizing agent (component (b)) is present in the paper in an amount greater than about 0.02% by weight based on the weight of the paper, and the at least one promoter resin (component (c)) is present in the paper in an amount greater than about 0.005% by weight based on the weight of the paper.

The disclosure is applicable to sizing treatment of one or both sides of paper or liner board. When only one side is being treated, all of the above levels relating to the paper will be one half of the values listed.

The final paper may contain other additives included in the formation of the paper or applied along with the sizing composition surface treatment or separately from the sizing composition surface treatment. The additives applicable are those which are utilized in paper. They include but are not limited to the following: inorganic and organic fillers, such as clay or hollow sphere pigments; optical brightening agents, which are also know as fluorescent whitening aids; pigments; dyes; strength additives, such as polyamidoamines; adhesion promoting polymers, such as styrene acrylic latexes and styrene maleic anhydride based polymers; waxes; and inorganic salts, such as sodium chloride and calcium chloride.

The methods of applying the size press composition to paper or liner board are not limited provided that uniform controlled application is obtained. The treatment may be made to paper formed on a paper machine and then only partially dried, or it can be made on a paper machine to dried paper or the treatment can be done separate from the paper machine to paper that was formed, dried, and moved. A typical process is for paper to be formed with a paper machine and partially dried. A sizing treatment then is applied with a paper machine size press. Then, the paper is dried again. The paper may be further modified by calendaring. The invention is equally applicable to production of other types of paper where cationic latex sizing agents are used to produce sizing and where the size press runs at a pH below 7. The applicable grades of paper are those with basis weights from about 50 to 350 g/m$^2$, more preferably from about 70 to 250 g/m$^2$.

EXAMPLES

The following examples are for illustrative purposes only and do not limit the scope of the disclosure.

In this disclosure the sizing and sizing agents are defined in terms of the ability to hold out a water-based ink solution used in the Hercules Sizing Test. This test is defined below Sizing is also defined by a Cobb test which is described below.

Hercules Sizing Test

Descriptions of various sizing tests can be found in *The Handbook of Pulping and Papermaking*, by Christopher J. Biermann, Academic Press (1996), San Diego, ISBN 0-12-097362-6; and *Properties of Paper: An Introduction*, ed. William E. Scott and James C. Abbott Tappi Press (1995), Atlanta, ISBN 0-89852-062-2. The Hercules Sizing Test (HST) used in these Examples is described by Tappi Method T530. For the test results presented in this disclosure, a solution containing 1% napthalene green dye and 1% formic acid was used as the penetrant. The end point of the test was set at 80% reflectance.

Cobb Test

The Cobb test measures sizing by measuring the quantity of water absorbed by a sample of paper in a specified time as the paper is held between a metal ring and a plate. An area of 100 cm$^2$ of paper is exposed to 100 ml of water with the water at a height of 1 cm. In advance of testing, the paper (approximately 12.5×12.5 cm) is cut out and weighed. For the tests here, the water was kept on the paper for one minute. After pouring off the water, the ring is quickly removed and the sample is placed with wetted side up on a sheet of blotting paper. A second sheet of blotting paper is placed on top of the sample and a hand roller of 10 kg is run over the papers once forward and then backward. Care should be taken not to exert downward force on the roller. The paper sample is removed from the blotting papers and reweighed. The results are reported as the amount of water in grams absorbed per square meter of paper. A complete description of the test and the test equipment are available from Gurley Precision Instruments (see http://www.gpi-test.com/cobb.htm).

Preparation of Samples

Paper samples for the examples below were prepared either with a laboratory method or with a pilot paper machine. The general procedures are described here. Specific details are listed with each example.

For the laboratory method, base papers were prepared ahead of time on a commercial or pilot paper machine. The papers were made without any size press treatment—no starch, sizing agent, or other additives were applied to the surface of the formed paper. The pulp used to make the papers was prepared from recycle paper streams. The basis weight was 139 g/m$^2$ and the level of HST sizing was 5 seconds. Once made and dried the papers were stored for later use. For the experiments described here, the papers were treated at the Hercules Research Center with a laboratory bench top puddle size press.

The size press formulations were prepared by dissolving the starch for 45 minutes at 95° C., cooling, holding the starch at 65° C. The starch pH was adjusted as needed for individual experiments. To the starch was added other additives described in each example, and the pH was adjusted again. Then, the starch solution, still at 65° C. was used to treat the paper. For each base paper used, the amount of solution picked up through the rollers was determined and the additive levels set accordingly.

The size press consisted of a horizontal set of ten inch pinched rollers, one rubber coated and one metal, through which the paper was fed. A puddle of the size press treatment was held by the rollers and dams on the top side of the rollers. The rollers were held together with 14 pounds of air pressure. The paper passed through the puddle as it was pulled by the rollers, and through the rollers, to give a controlled and uniform level of treatment. The paper was allowed to sit for 30 seconds and then run through the size press a second time.

The level of treatment was controlled by the concentration of the treatment chemicals in the treatment solution which was a dissolved starch solution containing other additives. After the second pass through the size press, the paper was captured below the two rollers and immediately dried on a drum drier set at 210° F. (99° C.). The paper was dried to about a 3-5% moisture level. After drying, each sample was conditioned by aging at room temperature for five days (if the sample contained reactive sizing agent) and at least one day (if the sample did not contain reactive sizing agent).

Other samples used in the examples below were prepared on Hercules' pilot paper machine. The paper was made with conditions similar to those described above for the base sheets. The furnish stream was a combination of mostly recycle board paper with about 25% recycle magazine paper, and 15% recycle newsprint. The pulp was refined to a 350 CSF. About 0.75%, on a final paper basis, was cationic starch added at the wet-end of the paper machine. The paper basis weight was 138 g/m$^2$ and caliper was 8.8 mils.

On the paper machine, the first drier section was followed by a size press and then another drier section and then a set of calendaring rolls. The treatments of the disclosure were applied to the paper at the size press. A puddle size press mode was used. In the puddle mode, the liquid size press composition treatment solution was held along the rolls as a puddle through which the paper passed through the puddle and rollers. The pilot machine process imitated the process of a large paper machine. As with the laboratory studies, a solution of cooked (dissolved) starch was used as a carrier for treatment chemicals.

Example 1

(Comparison—Reactive and Non-Reactive Sizing Agents Without Promoter Resin)

Using the bench-top size press method described above, paper samples were surface sized with two different cationic latexes, and those same latexes combined each with a reactive sizing agent. An oxidized corn starch was used as the main size press component. It was used as a 10% solution and the final pick-up of the paper was 61.5%, meaning that the final paper contained 6.15 g of starch per 100 g of paper. The level of addition of the sizing agents in the final paper is noted in the table below. The size press solution was held at a pH of about 6. The samples were also run where the size press pH was lower. The reactive sizing agent added was Hercules imPress® ST900 surface sizing agent, which is a dimer emulsion containing a liquid dimer based on an unsaturated fatty acid.

TABLE 1

| Sample | Latex | Size Press pH | Level of Latex (%) | Level of Rx Size (%) | HST (sec) | 1" Cobb (g/m$^2$) |
|---|---|---|---|---|---|---|
| 1 | none | 7.0 | None | none | 2 | 145 |
| 2 | A | 6.0 | 0.1 | none | 112 | 88 |
| 3 | A | 6.0 | 0.08 | 0.02 | 221 | 39 |
| 4 | A | 4.8 | 0.1 | none | 301 | 29 |
| 5 | A | 4.8 | 0.08 | 0.02 | 336 | 25 |
| 6 | B | 6.0 | 0.1 | none | 111 | 107 |
| 7 | B | 6.0 | 0.08 | 0.02 | 212 | 40 |
| 8 | B | 4.7 | 0.1 | none | 221 | 70 |
| 9 | B | 4.7 | 0.08 | 0.02 | 245 | 31 |

Latex A = Giulini Pergluten K532
Latex B = Eka SP CE28

The sizing performance (as measured by the HST) of both latex samples improved as the pH was lowered. Higher HST values represent more sizing. At the same time, the one minute Cobb test values were lower. Lower Cobb numbers represent more sizing. At pH 6, the addition of a reactive sizing agent in place of a portion of the either latex sizing agent gave a fairly large increase of sizing as seen by higher HST and lower Cobb values. However, at pH 4.8 or 4.7 the change with the addition of reactive sizing agent was considerably less. The results are consistent with a drop-off of the efficiency of the reactive sizing agents at lower pH. Even though less effective at a lower pH, the reactive sizing agent added some sizing ability above just the cationic latex.

Example 2

(Reactive and Non-Reactive Sizing Agents With and Without Promoter Resin)

The same conditions of Example 1 were used again. The pick-up of the paper was again 61.5%. Papers sized with a polymer latex, with the same latex and reactive size, and the same latex and reactive size plus a promoter resin were tested. Table 2 lists the results.

TABLE 2

| Sample | Latex | Size Press pH | Level of Latex (%) | Level of Rx Size (%) | Level of Promoter (%) | HST (sec) |
|---|---|---|---|---|---|---|
| 1 | none | 7.0 | None | none | | 18 |
| 2 | A | 5.0 | 0.1 | none | none | 227 |
| 3 | A | 5.0 | 0.1 | 0.02 | none | 318 |
| 4 | A | 5.0 | 0.1 | 0.02 | 0.005 | 432 |

Latex A = Giulini Pergluten K532 Promoter Resin if P(DADMAC)

Addition of a reactive sizing agent improved the sizing over just the polymer latex. The addition of a low level of promoter resin in Sample 4 surprisingly led to a relatively large increase of sizing value using HST.

Example 3

(Reactive and Non-Reactive Sizing Agents With Promoter Resin)

In the same experiment as shown in Example 2, several different compounds that are useful as promoter resins were added. The level of promoter resin in the paper in each case was 0.005%. The latex was Pergluten K532 and a level was added to the size press to give 0.1% in the paper. The imPress® ST900 reactive sizing agent was added at a level to give 0.02% in the paper.

TABLE 3

| Promoter Resin | Size Press pH | HST (sec) | 1 min. Cobb (g/m$^2$) |
|---|---|---|---|
| None | 5.0 | 318 | 32 |
| Promoter A | 5.0 | 432 | 33 |
| Promoter B | 5.0 | 321 | 32 |
| Promoter C | 5.0 | 414 | 24 |
| Promoter D | 5.0 | 402 | 24 |
| Promoter E | 5.0 | 351 | 29 |

Promoter A = poly(dimethyldiallylammonium chloride)
Promoter B = terpolymer of dimethyldiallylammonium chloride, acrylic acid and diallylamine hydrochloride
Promoter C = a polyamidoamine sold commercially as Kymene 557H strength resin
Promoter D = a polyamidoamine sold commercially as Kymene 736 strength resin
Promoter E = a polymer formed from dimethylaminopropylamine and epichlorohydrin All of the promoter resins gave some increased sizing. Certain promoter resins provided a greater increase in HST sizing and others had a larger effect on Cobb sizing. In particular, the reactive sizing agents, Kymene® 557H wet strength resin and Kymene 736, were effective at improving sizing as measured by the Cobb test.

Example 4

(Reactive and Non-Reactive Sizing Agents With Promoter Resin)

In the experiment similar to that of Example 2, different levels of promoter resin and sizing agent were added. The latex was again Pergluten K532® added at 0.1% and the reactive sizing agent was again imPress® ST900. The size press pH in each case was 5.0. The results are shown in Table 4.

TABLE 4

| Level of Rx Sizing Agent (%) | Promoter Resin | HST (sec) |
|---|---|---|
| None | None | 213 |
| 0.02 | None | 243 |
| 0.02 | 0.005% P(DADMAC) | 282 |
| 0.02 | 0.0075% P(DADMAC) | 341 |
| 0.02 | 0.010% P(DADMAC) | 362 |
| 0.02 | 0.005% E-5131 promoter resin | 309 |
| 0.02 | 0.0075% E-5131 promoter resin | 271 |
| 0.02 | 0.0075% Kymene 557H | 347 |
| 0.02 | 0.0075% Kymene 736 | 469 |
| 0.035 | None | 385 |
| 0.035 | 0.009% P(DADMAC) | 532 |
| 0.035 | 0.013% P(DADMAC) | 550 |
| 0.035 | 0.013% E-5131 promoter resin | 407 |
| 0.035 | 0.013% Kymene 557H | 540 |
| 0.035 | 0.013% Kymene 736 | 460 |

Kymene® 557H wet strength resin and Kymene 736 are commercial polyamidoamine epichlorohydrin strength additives of Hercules Incorporated. E-5131 is a dicyandiamide based commercial cationic promoter resin from Hercules Incorporated.

At the lower level of reactive sizing agent, an increase in the level of poly-dimethyldiallylammonium chloride (P(DADMAC)) provided an increase in the level of sizing. Increasing the level of reactive sizing also provided more sizing. At the higher level of reactive sizing agent, all of the promoter resins still provided an increase in sizing.

Example 5

(Reactive and Non-Reactive Sizing Agents With and Without Promoter Resin)

A similar experiment was run again. Different latex sizing agents were tested with imPress® ST900 reactive sizing agent and with and without poly-dimethyldiallylammonium chloride (P(DADMAC)) promoter resin. The results are shown in Table 5. In all cases, the size press pH was 5.0, and the level of latex added was 0.15% in the final paper on a dry weight basis. The level of reactive sizing agent added in each sample was 0.03% in the final paper on a dry weight basis.

TABLE 5

| Latex | Sizing Agent | Promoter Resin | HST (sec) |
|---|---|---|---|
| None | no | no | 20 |
| A | no | no | 394 |
| A | yes | no | 516 |
| A | yes | yes | 619 |
| B | no | no | 377 |
| B | yes | no | 492 |
| B | yes | yes | 617 |
| C | no | no | 589 |
| C | yes | no | 506 |
| C | yes | yes | 675 |
| D | no | no | 425 |
| D | yes | no | 491 |
| D | yes | yes | 631 |

Latex A = Basoplast PR8367
Latex B = Eka SP CE28
Latex C = Giulini Pergluten K532
Latex D = Hercules imPress ST830 surface sizing agent With four different polymer latex sizing agents, enhanced performance over latex alone or latex with reactive sizing agent was obtained by the addition of a relatively low level of promoter resin.

Example 6

(Non-Reactive Sizing Agents With and Without Promoter Resin)

A similar experiment was run in which a cationic latex was tested with and without a reactive size promoter resin, but no reactive sizing agent was added. The size press was run at two different pH values. In all cases, the cationic latex used was Pergluten K532 and it was added at a level in the size press to give 0.1% in the final paper. Different promoter resins and different levels of promoter resin also were used. Table 6 lists the results.

TABLE 6

| Promoter Resin | Level of Promoter resin (%) | Size Press pH | HST (sec) |
|---|---|---|---|
| None | none | 5.0 | 136 |
| P(DADMAC) | 0.005 | 4.9 | 155 |
| P(DADMAC) | 0.015 | 5.0 | 243 |
| P(DADMAC) | 0.025 | 4.9 | 322 |
| Kymene ® 25XL | 0.005 | 5.0 | 186 |
| Kymene 25XL | 0.015 | 5.0 | 220 |
| Kymene 25XL | 0.025 | 5.0 | 245 |
| None | none | 7.0 | 83 |
| P(DADMAC) | 0.005 | 7.0 | 323 |
| P(DADMAC) | 0.015 | 7.0 | 202 |
| Kymene 25XL | 0.005 | 7.0 | 161 |
| Kymene 25XL | 0.015 | 6.9 | 170 |

Kymene 25XL is a cationic commercial polyamidoamine epichlorohydrin paper strength additive from Hercules Incorporated.

Quite surprisingly, the addition of small levels of reactive size promoter resin increased the sizing provided by the cationic latex. The promoter resins when used at the same level but without cationic latex provided no increase of sizing to the paper.

Example 7

(Pilot Paper Machine and Premixed Formulations)

A pilot paper machine was used to evaluate samples in the manner described above. The samples were as follows:

1) 100 g of cationic latex A (31% solids) was mixed with 33.7 g imPress® ST900 sizing agent. The ratio of polymer to dimer was 4:1.
2) 100 g of cationic Latex A was mixed with 33.7 g imPress® ST900 and 9.69 g of a 20% solution of P(DADMAC) in water. The ratios of polymer to dimer to promoter resins were 16:4:1.
3) 306.7 g of cationic Latex B (31% solids) was mixed with 100 g imPress® ST900 sizing agent. The ratio of polymer to dimer was 4:1.
4) 306.7 g of cationic Latex B was mixed with 100 g imPress® ST900 and 28.8 g of a 20% solution of P(DADMAC) in water. The ratios of polymer to dimer to promoter resins were 16:4:1.

The samples were each added to a size press starch solution of approximately 8% oxidized starch. Size press solutions adjusted to different pH values were tested. Conditions of the size press were adjusted to get 3.5% starch addition to the paper and 0.15% of the sizing premixes based on active material (the level of solids from the latex plus the level of dimer in the reactive sizing agent plus the level of promoter resin). The sizing mixtures were compared to the cationic latex samples added at the same 0.15% in the paper.

Table 7 lists the results of sizing.

TABLE 7

| Sizing Mixture | Size Press pH | HST (sec) | 1" Cobb ($g/m^2$) |
|---|---|---|---|
| Latex A | 6.0 | 388 | 30 |
| Premix 1 | 6.0 | 461 | 29 |
| Premix 2 | 6.0 | 506 | 26 |
| Latex B | 6.0 | 218 | 29 |
| Latex B | 7.0 | 159 | 47 |
| Premix 3 | 6.0 | 367 | 27 |
| Premix 3 | 7.0 | 425 | 24 |
| Premix 4 | 6.0 | 618 | 23 |
| Premix 4 | 7.0 | 723 | 22 |

Latex A = Basoplast PR8367
Latex B = Eka SP CE28

Results similar to the bench top size press studies were obtained. The addition of sizing agent to cationic latex improved sizing, and the further addition of promoter resin gave an even greater increase. Latex A alone gave 388 seconds in the HST test, whereas with dimer in place of some the latex the sizing was 461 seconds, and with the promoter resin it was 506 seconds. The samples were run with a size press at pH 6.

The sizing of cationic Latex B decreased as the pH of the size press solution increased from 6.0 to 7.0. When reactive sizing agent was present in place of some of the latex, the sizing improved at pH 6 and pH 7. However, the improvement was larger at pH 7. When both sizing agent and promoter resin were present with the latex, the sizing was still improved the most at pH 7, but the sizing at pH 6 improved much more than without the promoter resin.

The sizing results measured by the Cobb test agreed completely with the HST results.

The results in Example 7 demonstrate that the cationic latex, reactive sizing emulsion, and promoter resin may be premixed.

The foregoing description illustrates and describes the present disclosure. Additionally, the disclosure describes the preferred embodiments. It is to be understood that changes or modifications within the scope of the concept as expressed herein, commensurate with the above teachings and/or skill or knowledge of the relevant art are considered part of the disclosure. The embodiments described hereinabove are further intended to explain best modes known of practicing the disclosure, and to enable others skilled in the art to utilize the disclosure in such, or other, embodiments and with the various modification required by the particular applications or uses disclosed herein. Accordingly, the description is not intended to limit the disclosure to the form disclosed herein. Also, it is intended that the appended claims be construed to include alternative embodiments.

All publications, patents and patent applications cited in this specification are herein incorporated by reference, and for any and all purposes, as if each individual publication, patent or patent application were specifically and individually indicated to be incorporated by reference. In the case of inconsistencies, the present disclosure will prevail.

The term "comprising" and its grammatical variations is used in the inclusive sense of "having" or "including" and not in the exclusive sense of "consisting only of". The terms "a" and "the" when used in this specification are understood to encompass the plural as well as the singular.

The invention claimed is:

1. A size press composition for sizing paper, comprising:
(a) at least one non-reactive cationic surface sizing agent,
(b) at least one reactive sizing agent,
(c) at least one promoter resin,
(d) water, and
(e) at least one binder,
wherein component (a) is present from about 0.15 to about 1% by weight based on the total weight of the size press composition, component (b) is present from about 0.025 to about 0.8% by weight based on the total weight of the size press composition, component (c) is present from about 0.01 to about 0.2% by weight based on the total weight of the size press composition, and binder (e) is present from about 2 to about 12% based on the total weight of the size press composition, and
wherein the size press composition pH is about 6 or below.

2. The size press composition as claimed in claim 1, wherein the at least one binder is a starch.

3. The size press composition as claimed in claim 1, wherein the at least one non-reactive cationic surface sizing agent is a polymer having monomeric units based on styrene, acrylates, or combinations thereof.

4. The size press composition as claimed in claim 1, wherein the at least one reactive sizing agent comprises an alkyl ketene dimer or an alkyl succinic anhydride.

5. The size press composition as claimed in claim 1, wherein the at least one promoter resin comprises at least one cationic polymer or copolymer comprising monomeric units based on dimethyldiallylammonium chloride (DADMAC), methylalkylallyl ammonium chloride or diallylammonium chloride (DAAC) monomers, or at least one cationic polymer that is a polyaminoamide resin.

6. A paper composition, comprising:
paper that is treated with a size press composition for sizing paper comprising:
(a) at least one non-reactive cationic surface sizing agent,
(b) at least one reactive sizing agent, and
(c) at least one promoter resin,
wherein on a dry weight basis component (a) is present in the paper in an amount greater than about 0.05% by weight based on the total weight of the paper composition, component (b) is present in the paper in an amount greater than about 0.02% by weight based on the total weight of the paper composition, and component (c) is present in the paper in an amount greater than about 0.005% by weight based on the total weight of the paper composition, and wherein the size press composition pH is about 6 or below.

7. The paper composition as claimed in claim 6, wherein the at least one non-reactive cationic surface sizing agent is a polymer having monomeric units based on styrene, acrylates or combinations thereof.

8. The paper composition as claimed in claim 6, wherein the at least one reactive sizing agent comprises an alkyl ketene dimer or an alkyl succinic anhydride.

9. The paper composition as claimed in claim 6, wherein the at least one promoter resin comprises at least one cationic polymer or copolymer comprising monomeric units based on dimethyldiallylammonium chloride (DADMAC), methylalkylallyl ammonium chloride or diallylammonium chloride (DAAC) monomers, or at least one cationic polymer that is a polyaminoamide resin.

10. The paper composition as claimed in claim 6, wherein the paper is recycled liner board paper, and wherein the paper has a basis weight between about 100 to about 200 g/m$^2$.

11. A method of producing a paper composition, comprising:

applying a size press composition to a paper or liner board paper, wherein the size press composition comprises:

(a) at least one non-reactive cationic surface sizing agent, (b) at least one reactive sizing agent, (c) at least one promoter resin, (d) water, and (e) at least one binder, wherein component (a) is present from about 0.15 to about 1% by weight based on the total weight of the size press composition, component (b) is present from about 0.025 to about 0.8% by weight based on the total weight of the size press composition, component (c) is present from about 0.01 to about 0.2% by weight based on the total weight of the size press composition, and binder (e) is present from about 2 to about 12% based on the total weight of the size press composition, and wherein the size press composition pH is about 6 or below.

12. The method of producing a paper composition as claimed in claim 11, wherein the size press composition is applied to the paper on the paper machine or is applied separately in a size press off the paper machine.

13. The method of producing a paper composition as claimed in claim 11, wherein the at least one non-reactive cationic surface agent is a polymer having monomeric units based on styrene, acrylates or combinations thereof.

14. The method of producing a paper composition as claimed in claim 11, wherein the at least one reactive sizing comprises an alkyl ketene dimer or an alkyl succinic anhydride.

15. The method of producing a paper composition as claimed in claim 11, wherein the at least one promoter resin comprises at least one cationic polymer or copolymer comprising monomeric units based on dimethyldiallylammonium chloride (DADMAC), methylalkylallyl ammonium chloride or diallylammonium chloride (DAAC) monomers, or at least one cationic polymer that is a polyaminoamide resin.

* * * * *